United States Patent [19]

Gardner

[11] 4,222,562

[45] Sep. 16, 1980

[54] BROOM FOR BROOM BALL GAME

[76] Inventor: Denys Gardner, 1529 Blvd. Acton, Acton Vale, Quebec, Canada, J0H 1A0

[21] Appl. No.: 967,081

[22] Filed: Dec. 4, 1978

[51] Int. Cl.[3] ..... A63B 69/14

[52] U.S. Cl. ..... 273/67 R; 15/159 R; 273/169

[58] Field of Search ..... 273/67 R, 129 R, 129 A, 273/129 B, 168, 129 D, 129 HA, 129 HB; 15/159 R, 245, 244, 111, 168

[56] References Cited

U.S. PATENT DOCUMENTS

| | | | |
|---|---|---|---|
| 1,414,124 | 4/1922 | Griffin | 273/167 R |
| 1,895,393 | 1/1933 | Isbell | 273/129 B |
| 2,735,129 | 2/1956 | Lorenz | 15/245 X |
| 2,919,455 | 1/1960 | Turner | 15/244 R X |
| 3,340,556 | 9/1967 | Allen | 15/159 R |
| 3,377,066 | 4/1968 | Trowbridge | 273/67 R |
| 3,671,038 | 6/1972 | Liard | 273/67 R |
| 3,674,270 | 7/1972 | Benjamin et al. | 273/67 R X |
| 3,720,410 | 3/1973 | Saytar | 273/67 A |
| 3,921,978 | 11/1975 | Warren | 273/67 R |
| 3,934,876 | 1/1976 | Haddad | 273/73 C |

FOREIGN PATENT DOCUMENTS

| | | | |
|---|---|---|---|
| 706285 | 3/1965 | Canada | 273/175 |
| 97436 | 6/1923 | Switzerland | 273/67 R |
| 607255 | 8/1948 | United Kingdom | 273/73 C |

*Primary Examiner*—George J. Marlo

[57] ABSTRACT

A broom which is particularly constructed to be used for a broom ball game and to provide relatively improved performances. In particular, this broom is balanced to be biased in the hands of the user toward self stabilization in the proper angular position to strike the ball, the bundle-like portion of the broom is more economically and readily made of rubber and is provided with apertures to offer reduced air resistance during a stroke, to accelerate heat curing of the rubber body, and to produce a predetermined weight unbalance between two opposite sides of the rubber body relative to the handle. This broom includes a stick, the bundle-like rubber body fixed at one end of the stick, and the rubber body transversely tapers and has cutting lines to selectively cut the bottom edge at a preferred angle in relation with the height of the user.

11 Claims, 5 Drawing Figures

BROOM FOR BROOM BALL GAME

This invention relates to a broom of the type adapted to play a broom ball game. The word "broom" is used here to identify the article of this invention, due to the broom-like planar configuration and function of this article and to be consistant with the terminology used to identify the corresponding accessory so far used to play the broom ball game.

The brooms of the above type which have been used and/or proposed so far have been made from a conventional broom, or in any case with a bundle of fibers very similar to the head of a conventional broom covered with a thin layer of latex. There thus resulted brooms which were not strictly conceived for their performance or attributes in relation with the broom ball game. For instance, the heretofore proposed brooms of the above type are found to vary in weight and shape from one broom to the other because they are handmade and this makes it difficult for the player to adapt to a new broom. The known brooms are also relatively dangerous for the opponent which may be struck by the very hard bundle portion of the broom. The fibers of such brooms rapidly break into pieces which considerably reduces the life and alters the performance of the previous brooms. The user of a known broom has to check if it is in position to strike the ball since such broom has a tendency to rotate in the user's hands and this hinders achieving accurate shots on the ball. Besides, the brooms so far made offer substantial air resistance during a stroke and this hinders the distance of the shots.

It is a general object of the present invention to provide a broom of the above type which is conceived to minimize the above mentioned disadvantages.

It is an object of the present invention to provide a broom of the above type which is particularly adapted to provide relatively improved performances compared to the heretofore proposed brooms.

It is another object of the present invention to provide brooms of the above type which are of uniform weight and shape.

It is another object of the present invention to provide a broom of the above type which is relatively more economical, long lasting, and safer compared to the brooms made with a bundle of fibers.

It is a further object of the present invention to provide a broom of the above type which has a slight weight unbalance relative to its longitudinal axis whereby the broom is biased in the hands of a user toward self-stabilization in the proper angular position to strike the ball.

It is still another object of the present invention to provide a broom of the above type which is adapted to offer relatively reduced air resistance during a stroke.

The above and other objects and advantages of the present invention will be better understood with reference to the following detailed description of a preferred embodiment thereof which is illustrated, by way of example, in the accompanying drawing in which.

Figures 1, 2, 3, 4, 5, 6:
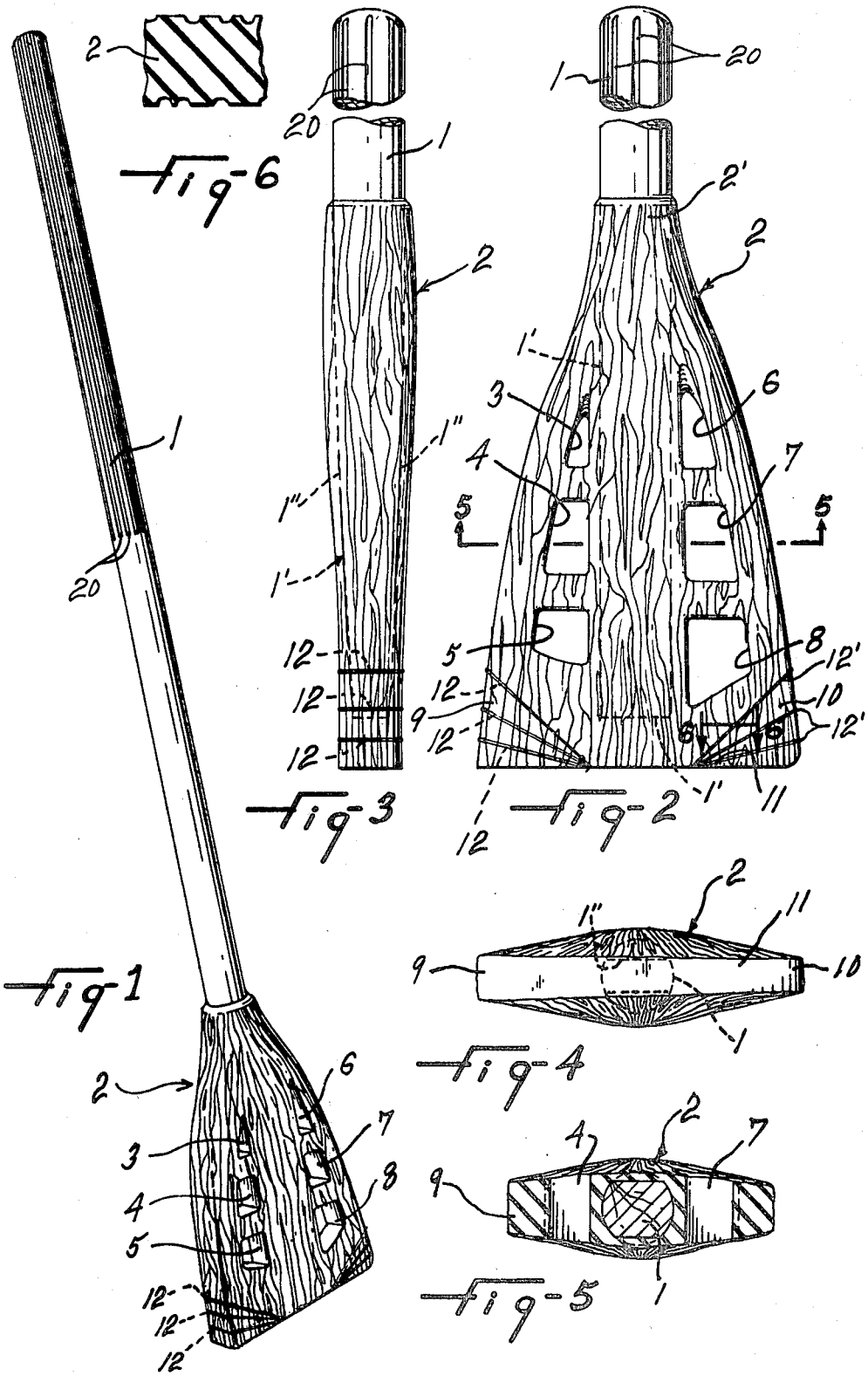
FIG. 1 is a perspective view of a broom according to the present invention.
FIG. 2 is an elevation of the broom of FIG. 1.
FIG. 3 is a side view of the same broom as seen from the left in FIG. 2.
FIG. 4 is a bottom view of the broom.
FIG. 5 is a cross-sectional view as seen along line 5—5 in FIG. 2.
FIG. 6 is a cross-sectional view as seen along line 6—6 in FIG. 2.

The illustrated broom includes a slender stick 1 of round cross-section forming the handle of the broom and being conventionally made of wood. Stick 1 has a longitudinally tapered end portion 1 formed by two opposite flat faces converging towards the tip of the stick. The broom also comprises a one-piece ball striking body 2 molded in the shape of the conventional bundle portion of a broom from a non-filamentary and non-brittle moldable substance. More particularly, the ball striking body 2 is preferably made from a rubber composition.

The ball striking body 2 is elongated and has relatively flat opposite main faces progressively widening from and merging with a cylindrical neck portion 2' from which stick 1 protrudes. Body 2 has a blind bore extending longitudinally, centrally of the body 2 and opening at neck 2'. The blind bore is tapered and is complementary to end portion 1' to receive the latter with a friction fit. The two converging flat faces 1'' of stick 1 prevent rotation of body 2 relative to stick 1. The ball striking body 2 longitudinally tapers from neck portion 2' to lower edge 11 when seen in side view. Body 2 has no boss at its opposite main faces as found at the junction of the stick and fibres in the conventional fibre broom. Stick 1 preferably has longitudinal grooves 20 equally spaced around the upper end portion of the stick to help prevent rotation of the latter in the player's hands. Apertures 3, 4, 5, 6, 7 and 8 extend through body 2 from one to the other of the flat faces on each side of the blind bore and of the stick portion 1'. Apertures 3, 4 and 5 extend through lateral edge portion 9 of body 2 while apertures 6, 7 and 8 extend through lateral edge portion 10 of body 2. The sum of the areas of the apertures 3–5 in lateral edge portion 9 is smaller than the sum of the areas of apertures 6–8 in lateral edge portion 10. At least the portion of the ball striking body adjacent its lower edge 11 transversely tapers in the direction from lateral edge portion 9 to the lateral edge portion 10. The above defined transverse taper, together with the above-noted unequal sums of apertures areas cumulatively produce a lateral edge portion 9 which is heavier than the lateral edge portion 10 with a resulting weight unbalance of the body 2 about the longitudinal axis of body 2 as defined by the longitudinal axis of the stick 1. Consequently, when the user holds the broom with the stick in his hands, the weight unbalance angularly biases the broom toward self-stabilization thereof with the lateral edge portion 9 extending downwardly edgewise and underlying the lateral edge portion 10. In such stabilized position, the flat faces are approximately vertical in readiness to effectively strike the ball.

The ball striking body 2 is formed with a blunt lower straight edge 11 transversely extending between the lateral edge portions 9 and 10. The operatively inward corner portion at the junction between the lower edge 11 and the lateral edge portion 9 is provided with small ribs 12 defining selective cutting lines angularly extending at different angles respectively between and relative to the lateral edge portion 9 and the lower edge 11. These ribs 12 allow selective cutting of the inward corner portion at one of the angles defined by the lines, in relation with the stature of the user of the broom. Similar ribs 12' can be added on the other side of body 2, arranged symmetrically to ribs 12 for use by players preferring a double bevelled broom.

The apertures 3–8 also provide for relatively fast and even heat curing of the body 2 upon molding thereof and finally serve to keep the weight of the broom within prescribed limits.

As shown in FIG. 6, the main faces of body 2 have a rough surface, for instance provided by grooves, to further prevent relative slipping between the ball and body 2.

What I claim is:

1. A broom for a broom ball game comprising a substantially straight stick having a tapered end portion, an elongated ball striking body having opposite main faces with substantially all of each main face being substantially flat, said main faces progressively widening from one end to the other end of said body, said body having a blind bore extending longitudinally and centrally through a major portion of said body, opening at said one end of said body and complementary to said tapered end portion, the latter securely fitted within said blind bore, said other end of said body forming an outer edge which has at least a substantially straight portion which extends transverse to the longitudinal axis of said stick, said ball striking body being molded in a one piece from a non-filamentary, moldable substance.

2. A broom as defined in claim 1, wherein said ball striking body, when seen in side view, longitudinally tapers from said one end to said outer end.

3. A broom as defined in claim 2, wherein said one end forms a substantially cylindrical neck surrounding said stick adjacent said tapered end portion.

4. A broom as defined in claim 1, 2 or 3 wherein said tapered end portion is formed by two opposite converging flat faces each facing one of said main faces.

5. A broom as defined in claim 1, 2, or 3, wherein said ball striking body defines lateral edge portions positioned on opposite sides of said blind bore, one of said lateral edge portions being heavier than the other to operatively bias the broom in the hands of a user toward self-stabilization thereof with said one lateral edge portion extending downwardly edgewise and underlying the other lateral edge portion.

6. A broom as defined in claim 1, 2 or 3, wherein said ball striking body includes apertures extending therethrough and opening at both main faces and located on each side of said blind bore, the aperture area on one side of said bore being smaller than the aperture area on the other side of said blind bore whereby said ball striking body has a weight unbalance about the longitudinal axis of said bore and of said stick.

7. A broom as defined in claim 1, 2 or 3 wherein at least the portion of said ball striking body adjacent to and including said other end tapers transversely of said ball striking body to produce a weight unbalance of said body about the longitudinal axis of said blind bore and of said stick.

8. A broom as defined in claim 1, 2 or 3 wherein said ball striking body defines first and second lateral edge portions respectively positioned on opposite sides of said blind bore, each lateral edge portion having apertures extending therethrough opening at both said main faces, the sum of the areas of the apertures located in said first lateral edge portion being smaller than the sum of the areas of the apertures located in said second lateral edge portion, and wherein at least the portion of said ball striking body adjacent to and including said other end tapers transversely of said ball striking body in a direction from said first to said second lateral edge portion, whereby said ball striking body has a weight unbalance about the longitudinal axis of said blind bore and of said stick.

9. A broom as defined in claim 1, 2 or 3 wherein said ball striking body has side edges which meet with said substantially straight outer edge portion to define corner portions, at least one of said main faces having markings defining selective cutting lines angularly extending at different angles respectively across one of said corner portions from the associated side edge to said substantially straight outer edge, thereby allowing selective cutting of said corner portion at one of said angles in relation with the stature of a user of the broom.

10. A broom as defined in claim 1, 2 or 3 wherein said substance is a rubber composition and said main faces have a rough surface.

11. A broom as defined in claim 1, wherein said moldable substance contains an elastomeric material.

* * * * *